US009713397B2

(12) United States Patent
Shields et al.

(10) Patent No.: US 9,713,397 B2
(45) Date of Patent: Jul. 25, 2017

(54) MODULAR DISPLAY FRAMES AND SYSTEM FOR MAGNETICALLY COUPLED ARRANGEMENTS

(71) Applicant: HALLMARK CARDS, INCORPORATED, Kansas City, MO (US)

(72) Inventors: Christopher Jason Shields, Kansas City, MO (US); Nicholas Pedersen, Lawrence, KS (US); Max J. Younger, Roeland Park, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 278 days.

(21) Appl. No.: 14/541,782

(22) Filed: Nov. 14, 2014

(65) Prior Publication Data

US 2016/0135619 A1 May 19, 2016

(51) Int. Cl.
*A47G 1/06* (2006.01)
*G09F 1/12* (2006.01)

(52) U.S. Cl.
CPC ..... *A47G 1/06* (2013.01); *A47G 1/065* (2013.01); *A47G 2001/0672* (2013.01); *G09F 1/12* (2013.01)

(58) Field of Classification Search
CPC ..... A47G 1/06; G09F 1/12
USPC ..... 40/711, 734, 757, 606.18; 248/467
See application file for complete search history.

(56) References Cited

U.S. PATENT DOCUMENTS 3,456,374 A * 7/1969 Baermann ..... G03B 21/64 40/600
3,877,165 A * 4/1975 Lumbard ..... G09F 1/12 40/617
4,785,562 A * 11/1988 Good ..... G09F 1/12 40/600
5,347,253 A 9/1994 Ogikubo
7,154,363 B2 12/2006 Hunts
7,301,759 B2 * 11/2007 Hsiung ..... H05K 5/0234 248/188

(Continued)

OTHER PUBLICATIONS

Van Oers, Marga, StoryTiles, dated Jun. 12, 2014, 1 page. http://www.storytiles.nl/en.

(Continued)

*Primary Examiner* — Syed A Islam
(74) *Attorney, Agent, or Firm* — Shook, Hardy & Bacon L.L.P.

(57) ABSTRACT

A modular display frame and system for hanging a plurality of modular display frames is provided. In embodiments, a modular display frame may be magnetically coupled to other modular display frames as well as a hanging bar component to create a plurality of display iterations. Each modular display frame includes two portions, each portion partially housing at least one magnet within a corner-located pocket, in embodiments. The modular display frame further includes a rounded side for creating a range of display angles when magnetically coupled to another frame along the rounded side, as well as a flat side for facilitating upright displays and vertically stacking magnetically coupled display frames, in further embodiments. A hidden hanging feature with auto-centering ability enables the modular frame to be hung on a wall, for example.

20 Claims, 6 Drawing Sheets

(56) References Cited

U.S. PATENT DOCUMENTS

| | | | | |
|---|---|---|---|---|
| 7,437,846 | B2 * | 10/2008 | Franco | A47G 1/065 206/449 |
| 7,841,115 | B2 | 11/2010 | Saunders-Singer | |
| 2008/0276513 | A1 * | 11/2008 | Jose | G09F 3/0295 40/654.01 |
| 2009/0100732 | A1 | 4/2009 | Seidler | |
| 2010/0024271 | A1 | 2/2010 | Seidler | |
| 2010/0229439 | A1 | 9/2010 | Elliot | |
| 2012/0285060 | A1 * | 11/2012 | Gross | A47G 1/065 40/711 |
| 2016/0073796 | A1 * | 3/2016 | Nesbitt | A47G 1/065 40/711 |

OTHER PUBLICATIONS

Feldstein, Sharon, Storysquares, dated Jun. 12, 2014, 7 pages http://www.fiddlesticksdallas.com/story_squares_by_demdaco_at_fiddlesticks.htm.

http://www.myurbio.com, dated Jun. 12, 2014, 1 page.

Canadian Office Action dated Jan. 11, 2017 in Canadian Patent Application No. 2,905,387, 6 pages.

* cited by examiner

MODULAR DISPLAY FRAMES AND SYSTEM FOR MAGNETICALLY COUPLED ARRANGEMENTS

SUMMARY

Embodiments of the invention are defined by the claims below, not this Summary. A high-level overview of various embodiments of the invention is provided here for that reason, to provide an overview of the disclosure, and to introduce a selection of concepts that are further described in the Detail Description section below. This Summary is not intended to identify key features or essential features of the claimed subject matter, nor is it intended to be used as an aid in isolation to determine the scope of the claimed subject matter.

In brief and at a high level, this disclosure describes, among other things, a display frame with magnetic coupling capabilities. In one embodiment, a display frame is provided. In another embodiment, one or more display frames for displaying photos is provided. In a further embodiment, a system for coupling a display frame to a hanging component is provided.

DESCRIPTION OF THE DRAWINGS

Illustrative embodiments of the invention are described in detail below with reference to the attached drawing figures, and wherein.

DETAILED DESCRIPTION

Figure 1:
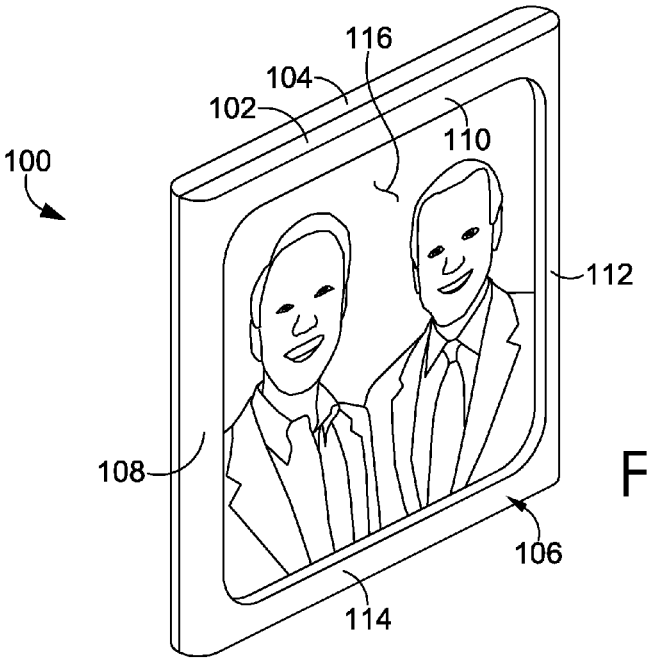
FIG. 1 is a front perspective view of a modular display frame with magnetic coupling capability, in accordance with an embodiment of the invention.

The subject matter of select embodiments of the invention is described with specificity herein to meet statutory requirements. But the description itself is not intended to necessarily limit the scope of the claims. Rather, the claimed subject matter might be embodied in other ways to include different components, steps, or combinations thereof similar to the ones described in this document, in conjunction with other present or future technologies. Terms should not be interpreted as implying any particular order or dependency among or between various components herein disclosed unless and except when the order or dependency between various components is explicitly described.

Embodiments of the invention are directed to a modular display frame having the ability to magnetically couple to one or more additional modular display frames. Additionally or alternatively, each display frame has the ability to magnetically couple to a separate hanging bar component. Multiple display configurations and iterations may be created using multiple display frames and/or the hanging bar component. The modular nature of the display frames and the magnetic coupling capability allows for the creation of customized display configurations that can be easily and quickly modified, altered, interchanged, and/or rearranged based on preference. The magnetic coupling capability facilitates easy coupling and decoupling of display frames that encourages playful arrangement and interactivity with the display frames. Further elements of each display frame allow a display object (e.g., a photo, a print, a memento, or functional tile) to be quickly removed and/or interchanged without disassembly of the display frame. This encourages personalization of the display frames and system, which may be adapted for different uses (e.g., functional tiles may include a chalkboard surface, cork surface, dry-erase board writing surface, temperature sensitive surface, tactile surface, fragrant coating surface, digital or screen surface, touch capacitive surface, or an analog clock) and environments (e.g., display on a work desk, display on a kitchen counter, display on a wall within the home, display on a refrigerator or other appliance, display within a school classroom).

In an embodiment, a display frame is provided. The display frame includes a first portion and a second portion being the same or similar in dimension, in various embodiments. The first portion and the second portion are generally configured to mate with one another to form the display frame. In embodiments, each of the first portion and the second portion include a body having a first arm, a second arm, a third arm, and a fourth arm. In some embodiments, the first arm opposes the third arm and/or the second arm opposes the fourth arm. Additionally and/or alternatively, each of the first, second, third and fourth arms may be terminally connected to each other to create a display area and form a perimeter of the body having four exterior corners and four interior corners, in embodiments. Each of the four interior corners may be curved or fillet-shaped, in some embodiments. In further embodiments, each of the four exterior corners includes a pocket configured to receive at least a portion of a magnet, such that when the first portion and the second portion are mated with one another, each pocket houses the corresponding at least a portion of the magnet within the display frame.

In another embodiment, one or more display frames are provided. Each of the one or more display frames includes a first half and a second half, the first half and the second half having mating elements for joining the first half to the second half to form the display frame. Each of the first half and the second half further include a body having a first arm terminally connected to a second arm, the second arm terminally connected to a third arm, the third arm terminally connected to a fourth arm, and the fourth arm terminally connected to the first arm, in some embodiments. The terminal connections of the first, second, third, and fourth arms are such that a perimeter is formed around a display area for displaying a photo or other display object. In embodiments, the body of the first half and the body of the second half further include four exterior corners corresponding to each terminal connection and four interior corners having a concave shape. The bodies of the first half and second half further include a pocket proximate to each terminal connection, in some embodiments, wherein each pocket is generally configured to house at least a portion of a magnet. As such, in embodiments, the whole magnet is secured when the first half and the second half are joined with one another to form the display frame. The magnet facilitates magnetic coupling of the one or more display frames to one another, in embodiments.

In yet another embodiment, a modular display system is provided. The modular display system includes at least one display component configured to display one or more photos within a display area. Additionally, the display component is composed of two identical portions configured to internally secure at least one magnet when the two identical portions are coupled to one another, in some embodiments. The internally secured magnet is placed or located proximate to a corner of the display frame, in further embodiments, so as to facilitate magnetic coupling of the display component to one or more of a second display component or a hanging component. In embodiments, the modular display system further includes at least one hanging bar component for magnetically coupling with the at least one display component via the at least one internally secured magnet. The at least one hanging bar component includes at least one securing component for facilitating affixing the hanging component to a surface, in some embodiments.

With reference now to the figures, a modular display frame with magnetic coupling capabilities and a corresponding display system are described in accordance with embodiments of the invention. Various embodiments are described with respect to the figures in which like elements are depicted with like reference numerals.

FIG. 1 is a front perspective view of a modular display frame 100 with magnetic coupling capability, in accordance with an embodiment of the invention. Accordingly, FIG. 1 provides a brief overview of various exemplary elements of a modular display frame 100 with magnetic coupling capability. The exemplary modular display frame 100 of FIG. 1 generally includes a first portion 102 and a second portion 104. Each of the first and second portions 102 and 104 includes a body 106 having a first arm 108, a second arm 110, a third arm 112, and a fourth arm 114, in embodiments. Each of the first, second, third, and fourth arms 108, 110, 112 and 114 may be sequentially connected end to end to form a perimeter of the body 106 and a display area 116 therein.

The first and second portions 102 and 104 are configured to mate with one another to form the complete display frame 100. Various coupling or mating elements may be used to adjoin the first and second portions 102 and 104 to one another. As such, generally, the first portion 102 and the second portion 104 are the same or similar in dimension (e.g., height, width, thickness, length). In further embodiments, the first portion 102 and the second portion 104 are identical. In yet further embodiments, the first portion 102 corresponds to a first half and the second portion 104 corresponds to a second half. The same or similar dimensions of the first and second portions 102 and 104 promote the uncomplicated assembly of the display frame 100, efficient and cost-effective molding and manufacture, and interchangeability that promotes interaction with the display frame 100. The similar dimensions of portions 102 and 104 allows for interchangeability between said portions so that the display frame 100 is completely customizable to suit both functional and aesthetic preferences. In further embodiments, the first and second portions 102 and 104 may be the same or similar in color, surface, finish, and/or coating, for example. Alternatively, the first and second portions 102 and 104 may be different in color, surface, finish, and/or coating, for example. For example, a red-colored first portion 102 may be mated with a blue-colored second portion 104 for an eclectic appearance. In another example, a stainless steel-finished first portion 102 may be mated with a stainless steel-finished second portion 104 for a seamless (e.g., reduce the visual differentiation between coupled portions) and uniform look.

Each of the first portion 102 and the second portion 104 comprise a body. As such, the first portion 102 has a body 106, and the second portion 104 has a body. For the purposes of simplicity and brevity, the body 106 of the first portion 102 will generally be described. It will be understood that the body of the second portion 104 may be the same or similar in dimension, qualities, characteristics, and/or functionality as body 106 of the first portion 102. However, the description of the body 106 of the first portion 102 should not be considered limiting to the body of the second portion 104 unless otherwise expressly described as such. The body 106 generally includes at least three arms. In further embodiments, the body 106 includes at least four arms. Any number of arms may be employed in various embodiments of the invention to achieve display frames of various shape and magnetic coupling functionality. In embodiments having at least four arms, the body 106 includes a first arm 108, a second arm 110, a third arm 112 and a fourth arm 114. In one example, the first and third arms 108 and 112 are located opposite one another on the body 106, such that they are opposing. In such an example, the first and third arms 108 and 112 may be the same or similar in size, shape, and/or configuration (e.g., parallel with respect to one another, similar angle of connection to adjacent arms). Additionally and/or alternatively, the second and fourth arms 110 and 114 are located opposite one another on the body 106, such that they are opposing, for example. In such an example, the second and fourth arms 110 and 114 may be the same or similar in size, shape, and/or configuration (e.g., parallel with respect to one another, similar angle of connection to adjacent arms) to one another. Additionally and/or alternatively, the second and fourth arms 110 and 114 may be the same or similar in size, shape, and configuration to one or more of the first and third arms. As such, in further embodiments, all the arms of the body 106 may be the same or similar in size, shape and/or configuration. Alternatively, each of the arms of the body 106, or pairs of arms of the body 106, may be the same or similar in size, shape and/or configuration. One or more of the arms of the body 106 may be integrally formed with the body 106, such that portions of the body 106, or the whole body 106, are of a unitary construction (e.g., injection molded), in some embodiments. Alternatively, one or more of the arms of the body 106 are not integrally formed, in some embodiments.

In further embodiments, the first arm 108 of the first portion 102 may be the same or similar in size, shape, and/or configuration as the first arm of the second portion 104. For example, the first arm 108 of the first portion 102 and the first arm of the second portion 104 may be quarter-elliptical in shape such that when the first portion 102 and the second portion 104 are mated with one another, the first arm 108 of the first portion 102 and the first arm of the second portion 104 are adjacent to one another and form a half-elliptical shape for facilitating angled configurations of the display frame 100 magnetically coupled to a second display frame (see, e.g., FIG. 7A). In various embodiments, the first arm 108 of the first portion 102 may be partially round, partially convex, and/or bull-nosed in order to form a rounded, curved, convex, and/or elliptical side of the display frame 100 when adjacent to the first arm of second portion 104. In another example, the second arm 110 of the first portion 102 and the second arm of the second portion 104 may each have at least one flat surface such that when the first portion 102 and the second portion 104 are mated with one another, the second arm 110 of the first portion 102 and the second arm of the second portion 104 are adjacent to one another and form a combined or composite flat surface for facilitating an upright configuration of the display frame 100.

In further embodiments, the first arm may be oriented so as to be parallel to the third arm and/or the second arm may be oriented so as to be parallel to the fourth arm. In yet further embodiments, the first arm might be perpendicular to the second arm, the second arm perpendicular to the third arm, and the fourth arm perpendicular to the first arm, or a combination thereof, for example. In some embodiments, each of the first, second, third and fourth arms 108, 110, 112 and 114 of a body 106 are terminally connected to each other (e.g., end to end) to form a closed shape, or a loop. In some embodiments, all of the first, second, third and fourth arms 108, 110, 112 and 114 are terminally connected to each other, for example. In other embodiments, one or more of the arms of the body 106 are connected to another arm, the connection being at or near the terminus of each connected arm. The terminal and/or near-terminal connections of the arms of the body 106 create a perimeter of the body 106. Each terminal connection may further create a corner on the exterior of the body 106, and an interior corner, for example. The perimeter of the body 106 may surround a display area 116, in embodiments. The interior corners may be located interiorly with respect to the perimeter of the body 106, the exterior corners, and/or surrounding arms. Accordingly, the interior corners are generally located adjacent to and/or proximate to the display area 116, so that the interior corners frame a photo or display object displayed therein, in embodiments. The exterior corners are exterior with respect to the perimeter of the body 106 and corresponding arms.

The display area 116 is generally centrally located within the body 106, with respect to the arms of the body 106. For example, the display area 116 may be located interiorly, such that the arms of the body 106, as connected, surround and define the display area 116. The display area 116, in some embodiments, is flanked by interior corners (see e.g., FIG. 2B) of the arms and/or body 106. Interior corners are interior with respect to the arms and/or perimeter of the body 106. Such interior corners may be curved, concave, rounded, or otherwise extend toward and/or into the display area 116. The shape, size, and dimensions of said interior corners may be configured to retain or secure edges and/or corners of a photo inserted into the display area 116, for example.

Figure 2A:
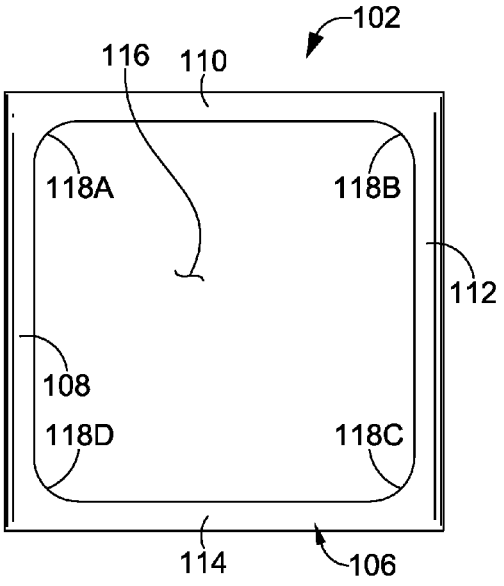
FIG. 2A is a front elevation view of the exterior of an exemplary first portion of a modular display frame with magnetic coupling capability, in accordance with an embodiment of the invention.

Turning now to FIG. 2A, a front elevation view of the exterior of an exemplary first portion 102 of the modular display frame of FIG. 1 with magnetic coupling capability is depicted, in accordance with an embodiment of the invention. As described above with regard to FIG. 1, the first portion 102 and the second portion (not shown in FIG. 2A) may be the same or similar in size, shape, and/or dimension. As such, the first portion will be discussed at length with the understanding that the second portion may include or have the same or similar elements, qualities, characteristics, relationships to other elements, and/or functionality as the first portion 102. In the example of FIG. 2A, the body 106 of the first portion 102 includes four arms that are the same of similar in size, shape and dimension, and further, are terminally connected to one another. The exterior of the exemplary first portion 102, as shown, has a smooth appearance. In other embodiments, the exterior of the exemplary first portion 102 may have a rough appearance, or any other appealing texture. When the first portion 102 is mated and/or coupled to the second portion 104, the exterior of the first portion 102 and the exterior of the second portion are outwardly visible. As such, the exterior may be any color, finish, coating, pattern, texture, etc., that may be desirable with respect to the display. Additionally, the exterior of the first and second portions 102, 104 may hide internal elements, features, and/or components of the display frame that are not visually appealing, and/or may protect internal elements, features, and/or components of the display frame against breakage. Additionally interior corners 118A, 118B, 118C and 118D formed by the terminal connection of one or more arms 108, 110, 112 and 114 of the body 106 have a concave or fillet shape. The size, shaped, and/or dimensions of the interior corners 118A, 118B, 118C and 118D, as explained above, may help in retaining and/or securing one or more corners of an inserted photo, for example. The corners of an inserted photo may be inserted underneath the fillet-shaped interior corners 118A, 118B, 118C and 118D (e.g., placed behind the fillet shape such that the corners contact the interior of the body 106) and retained therein, while displaying all or substantially all of a photo within the display area 116 such that the corners of said photo are not outwardly visible, in further embodiments.

Figure 2B:
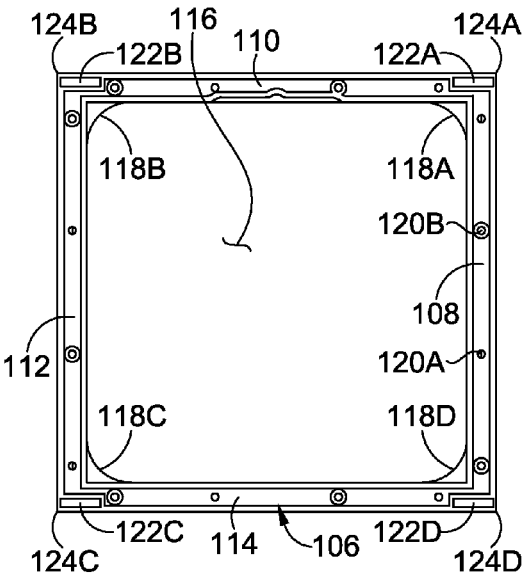
FIG. 2B is a rear elevation view of the exemplary first portion of the modular display frame of FIG. 2A illustrating an interior thereof.

FIG. 2B presents a rear elevation view of the interior of the exemplary first portion 102 of a modular display frame with magnetic coupling capability, in accordance with an embodiment of the invention. In the example of FIG. 2B, the body 106 of the first portion 102 includes four arms 108, 110, 112 and 114 that are the same or similar in size, shape and/or dimension, and further, are terminally connected to one another to form or create a closed shape or perimeter of the body 106. When the first portion 102 is mated and/or coupled to the second portion, the interior of the first portion 102 and the interior of the second portion will not be outwardly visible, in embodiments. In such embodiments, the interior of each portion 102 and 104 forms the interior of the display frame. As depicted, the first portion 102 includes one or more mating elements 120A and 120B which facilitate mating and/or coupling of the first portion 102 to the second portion 104 such that the interior of each portion abuts one another, in embodiments. Generally, the one more mating elements 120A and 120B may mechanically mate and/or couple the first portion 102 to the second portion 104. The one or more mating elements 120A and 120B may also utilize an adhesive to assist securing the first portion 102 to the second portion 104, in further embodiments. Generally, in some embodiments, the exemplary mating elements 120A and 120B of the first portion 102 are complementary to the mating elements of the second portion 104. For example, the first portion 102 may have mating elements 120A and 120B that are female and configured to receive male mating elements of the second portion 104. In another example, the first portion 102 may have a combination of female mating elements 120B and male mating elements 120A and, wherein the female mating elements 120B are configured to receive male mating elements 120A of the second portion 104, and wherein the male mating elements 120A are configured to receive female mating elements 120B of the second portion. Any number of mating elements 120A and 120B and any kind of mating elements 120A and 120B may be employed herein. The number and type of mating elements 120A and 120B depicted in FIG. 2B are for illustration purposes only and should not be considered limiting. In the illustrated embodiment, the first and second portions 102, 104 are identical in construction. Accordingly, the mating elements 120A and 120B alternate so as to permit mating by identical pieces.

In addition to mating elements 120A and 120B, the interior of the first portion 102 includes at least one pocket 122A. In the illustrated embodiment the first portion includes pockets 122A, 122B, 122C and 122D. The pockets 122A, 122B, 122C and 122D are configured to receive, hold, and/or house at least a portion of a magnet. In further embodiments, the pocket 122A, 122B, 122C and 122D is configured to receive half of a magnet. In yet further embodiments, the size, shape, and or dimensions of the pocket 122A, 122B, 122C and 122D are complementary to the size, shape, and/or dimensions of the magnet to be placed therein. Additionally, the location of one or more pockets 122A, 122B, 122C and 122D of the first portion 102 are arranged to correspond to, and/or align with, one or more pockets of the second portion 104. Thus, a portion of a magnet will be housed and/or secured within a pocket 122A, 122B, 122C and 122D of the first portion 102 while the remaining portion of the same magnet will be housed and/or secured within a pocket of the second portion 104 that corresponds to a pocket 122A, 122B, 122C and 122D of the first portion 102. As such, the pockets of each portion align when the first portion 102 and the second portion 104 are mated with one another using the mating elements 120A and 120B.

As depicted in exemplary FIG. 2B, for example, each of the at least one pocket 122A, 122B, 122C and 122D is generally located at or near an exterior corner 124A, 124B, 124C and 124D of the body 106 of the first portion 102. Generally, the one or more pockets 122A, 122B, 122C and 122D are located proximate to each exterior corner 124A, 124B, 124C and 124D of the body 106 to optimize magnetic coupling of the display frame to one or more additional display frames (see, e.g., FIG. 7A) and/or a hanging bar component (see, e.g., FIG. 6A), for example.

Figure 3:
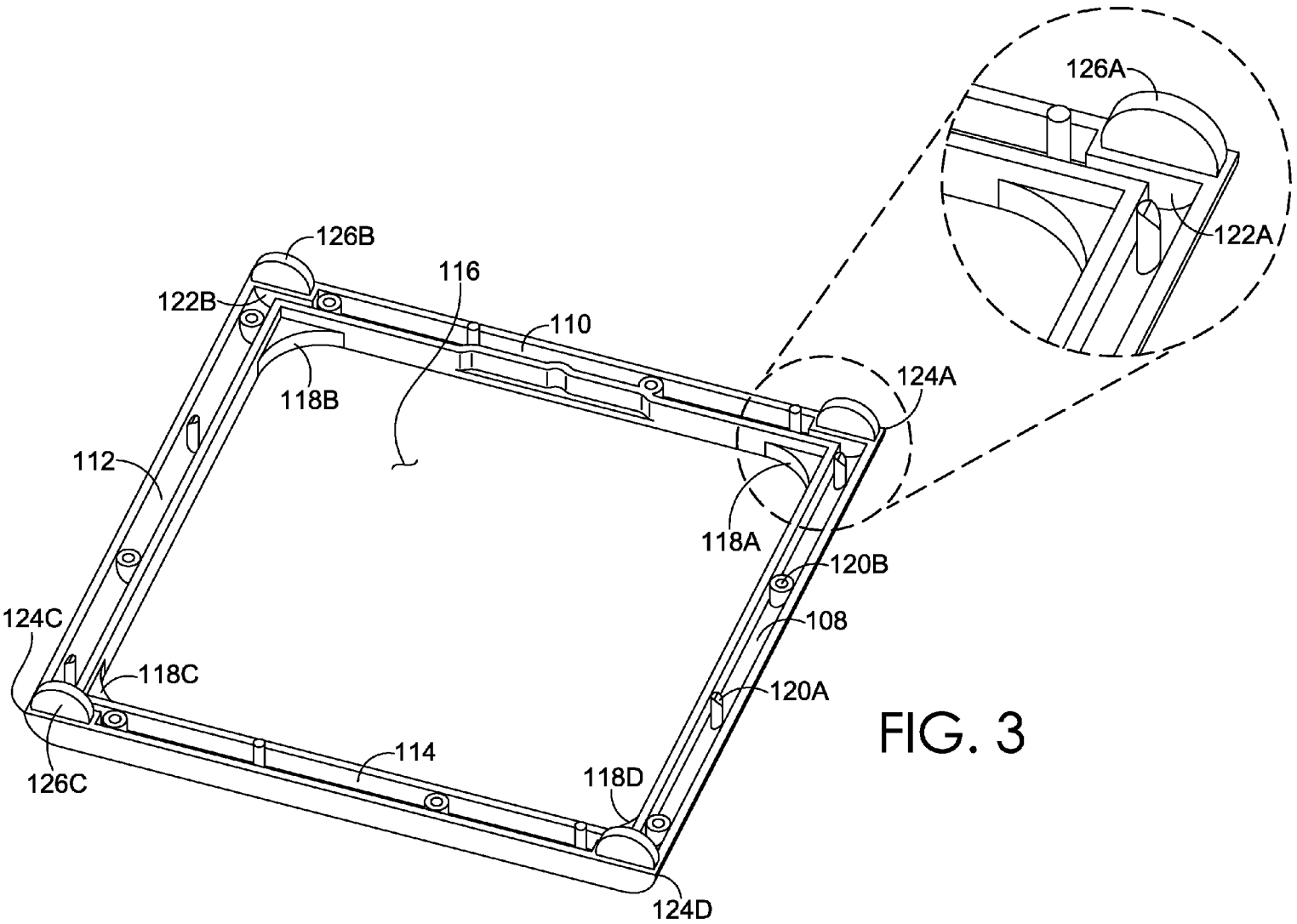
FIG. 3 is a rear perspective view of the exemplary first portion of the modular display frame of FIG. 2A with an enlarged view of a pocket having an inserted magnet, in accordance with an embodiment of the invention.

Turning to FIG. 3, it depicts a rear perspective view of the exemplary first portion 102 the modular display frame of FIG. 1 with magnetic coupling capability showing an interior thereof with an enlarged view of pocket 122A having an inserted magnet 126A, in accordance with an embodiment of the invention. In exemplary FIG. 3, at least one magnet 126A, 126B, 126C and 126D is placed into each pocket 122A, 122B, 122C and 122D, wherein a portion of the at least one magnet 126A, 126B, 126C and 126D is held therein. The remaining portion of each magnet 126A, 126B, 126C and 126D may be held with a pocket of the second portion 104 of the display frame that corresponds to a pocket 122A, 122B, 122C and 122D of the first portion 102. In various embodiments, one or more pockets 122A, 122B, 122C and 122D of the first portion 102 are configured to hold, house, and/or secure a half of a magnet, less than half of a magnet, or more than half of a magnet. As such, for example, all or substantially all of the remaining portion of the magnet 126A not held within the pocket 122A of the first portion 102 will be placed within a corresponding pocket of the second portion 104. In some embodiments, the at least one pocket of the second portion 104 is configured to hold, house and/or secure a half of a magnet, less than half of a magnet, or more than half of a magnet, so as to complement the unhoused, unsecured, and/or remaining portion of a magnet in a corresponding pocket of the first portion 102. Accordingly, each magnet is shared between a pocket (e.g., 122A) of the first portion 102 and a pocket of the second portion 104. In embodiments, the magnets within the pockets of the first and second portions do not serve to couple the first portion 102 to the second portion. And, as held, housed and/or secured within various pockets of the display frame, magnets may be stationary and fixed in place, or alternatively, magnets may have some degree of freedom of movement within a corresponding pocket.

In various embodiments, each pocket 122A, 122B, 122C and 122D may be configured to receive a magnet 126A, 126B, 126C and 126D such that the polarity of the received magnet 126A, 126B, 126C and 126D is stable and arranged for optimized magnetic coupling. For example, the strongest area of a magnetic field of the magnet 126A, 126B, 126C and 126D is generally created near the magnetic pole. As such, the at least one pocket 122A, 122B, 122C and 122D may be configured such that the magnetic pole of the magnet 126A, 126B, 126C and 126D, as placed therein, is close to the exterior and/or an exterior corner 124A, 124B, 124C and 124D of the body 106. Additionally, the at least one pocket 122A, 122B, 122C and 122D may be configured such that a magnetic pole (e.g., north or south, negative or positive) of the magnet 126A, 126B, 126C and 126D, as placed therein, is outward facing such that is the strongest magnetic field is exposed, thereby maximizing magnetic coupling of display frames to one another and/or to a hanging bar component (see, e.g., FIG. 6A). In further embodiments, the at least one pocket 122A, 122B, 122C and 122D is configured to hold a portion of the magnet 126A, 126B, 126C and 126D such that the magnetic pole is outward facing and perpendicular to a flat surface of an arm (e.g., the second arm 110). In one exemplary aspect, the combination of an outward facing magnetic pole of a magnet (e.g., magnet 126A within pocket 122A), as aligned with a flat surface of an arm (e.g., the second arm 110) so as to take advantage of the strongest magnetic force of the magnetic field optimized magnetic coupling of one or more display frames to each other and/or to an hanging bar component.

Referring again to FIG. 3, each of the interior corners 118A, 118B, 118C and 118D may have a round, concave, curved, and/or fillet-shaped configuration in order to secure an edge and/or a corner of a photo received by the display area 116, for example. The interior corners 118A, 118B, 118C and 118D are generally offset or set back from the interior of the body of each portion (e.g., the body 106 of the first portion 102). In contrast, the interior corners 118A, 118B, 118C and 118D are generally not offset from the exterior of the body 106, as shown in exemplary FIG. 2A, for example. In various embodiments, the interior corners 118A, 118B, 118C and 118D may be offset from the interior of the body 106, the exterior of the body 106, or both. Offsetting the interior corners 118A, 118B, 118C and 118D from the interior of the body 106 enables the insertion of an edge and/or corner of a photo or display object into the display frame such that the edge and/or corner of the photo or display object is not outwardly visible when the first portion 102 is coupled to the second portion. Additionally and/or alternatively, the interior corners 118A, 118B, 118C and 118D are configured to receive, retain, and/or otherwise secure an edge and/or a corner of more than one photo at a time. In such embodiments, more than one photo may be simultaneously displayed in the display frame via the display area 116. When more than one photo, for example, is received by or inserted into the display frame, each photo may face outward in opposing fashion, such that one photo is visible within the display area 116 when viewed via the first portion 102 while another photo is visible within the display area 116 when viewed via the second portion 104.

Figure 4:
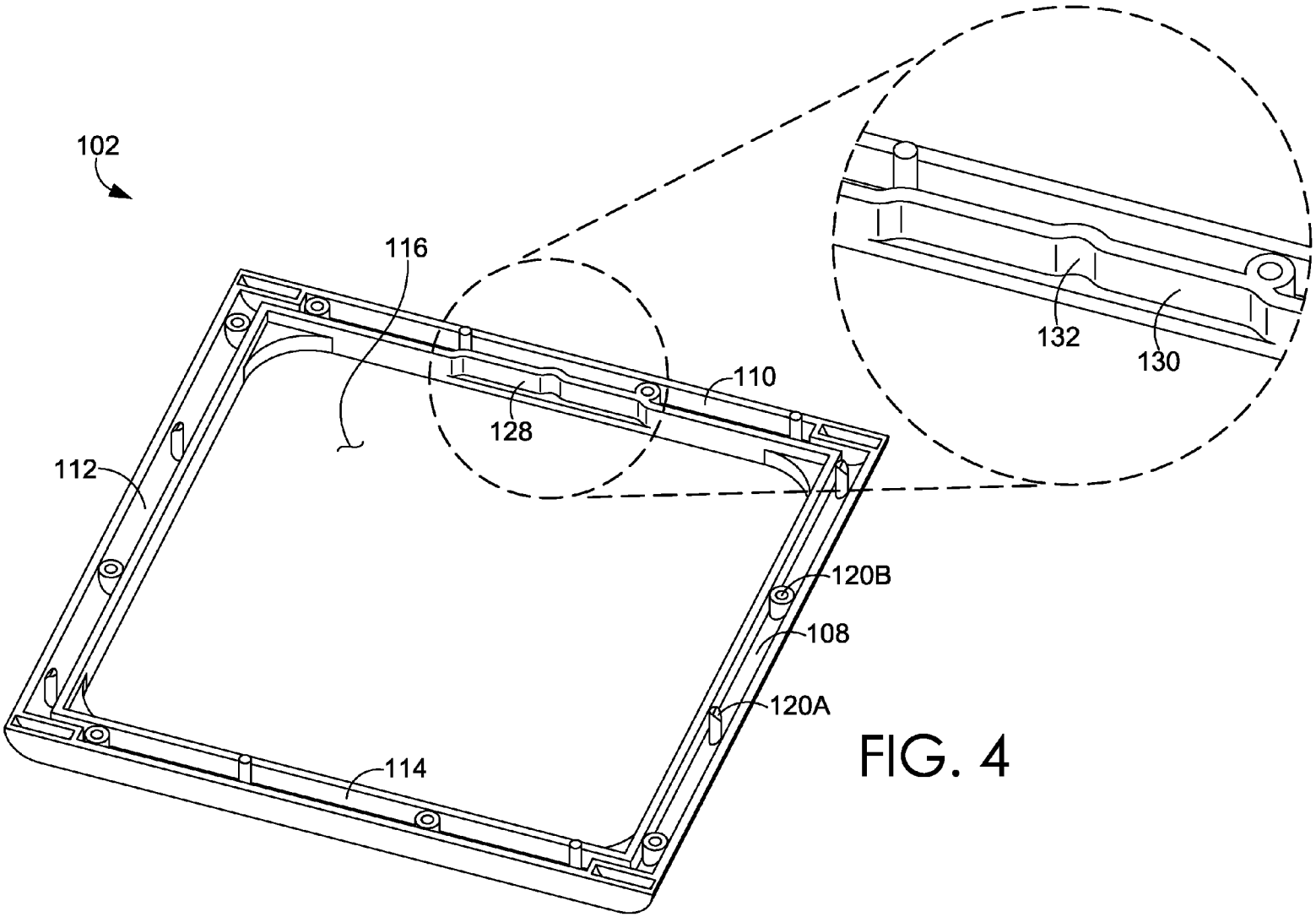
FIG. 4 a rear perspective view of the exemplary first portion of the modular display frame of FIG. 2A with an enlarged view of a hanging feature, in accordance with an embodiment of the invention.

FIG. 4 is a rear perspective view of the exemplary first portion 102 of a modular display frame with magnetic coupling capability illustrating an interior with an enlarged view of a hanging feature, in accordance with an embodiment of the invention. In FIG. 4, the body 106 of the exemplary first portion 102 includes a portion of a hanging feature 128. In embodiments, the second portion 104 includes a portion of the hanging feature 128 such that when the first and second portions are coupled to one another, the hanging feature 128 is complete. In further embodiments, each of the first and second portions include one half of the hanging feature 128. In other embodiments, the first portion 102 includes less than half of the hanging feature 128 while the second portion includes more than half of the hanging feature 128, or vice versa. The hanging feature 128 and/or each portion of the hanging feature 128 is generally configured to assist with hanging the display frame from a nail, screw, and/or hook, etc. The hanging feature 128 and/or each portion of the hanging feature 128 has at least a portion of a groove 130 and at least a portion of a centrally located notch 132. The groove 130, or a portion thereof, may be centrally located on one or more arms of each portion. The groove 130 may be recessed into one or more arms of each portion. The groove 130, or a portion thereof, may be smooth, scalloped, and/or "saw-toothed" in order to grip or hold the head of a screw, nail, or hook, for example. The groove 130 provides an edge or ledge onto which a screw head, nail head, and/or hook may be caught. Once a nail, screw or hook is caught by the groove 130, the notch 132 further provides an auto-centering feature of the display frame. In embodiments where the notch 132 is centrally located within the groove 130, and the groove 130 is centered along a corresponding arm, the notch 132 can be used to balance and hang the display frame automatically. Thus, the display frame may be easily affixed to a surface such that the display frame is automatically centered on the nail, screw, and/or hook, for example.

In further embodiments, a display frame may have one or more hanging features to lend further configuration versatility (e.g., orientation and/or rotation of a display frame). For example, multiple hanging features might enable the display frame to be affixed to a wall in different orientations depending on preference and the photo or display object inserted into or received by the display area 116. Additionally, each portion of the hanging feature 128 is offset or set back from the exterior of the body 106, in embodiments. As such, the hanging feature 128 may not be outwardly visible or may be hidden from view, in embodiments. The offset enables the display of more than one photo or display object within a display frame without having an unsightly hanging element that mars the aesthetics of the exterior of each portion when the display frame is placed on a desk, for example, and not hung upon a wall. The offset further enables the display frame to be used both sitting on a surface and hung from a surface, for example, without the need to attach or detach the hanging feature 128. This provides further configuration versatility to the modular display frames.

Figure 5:
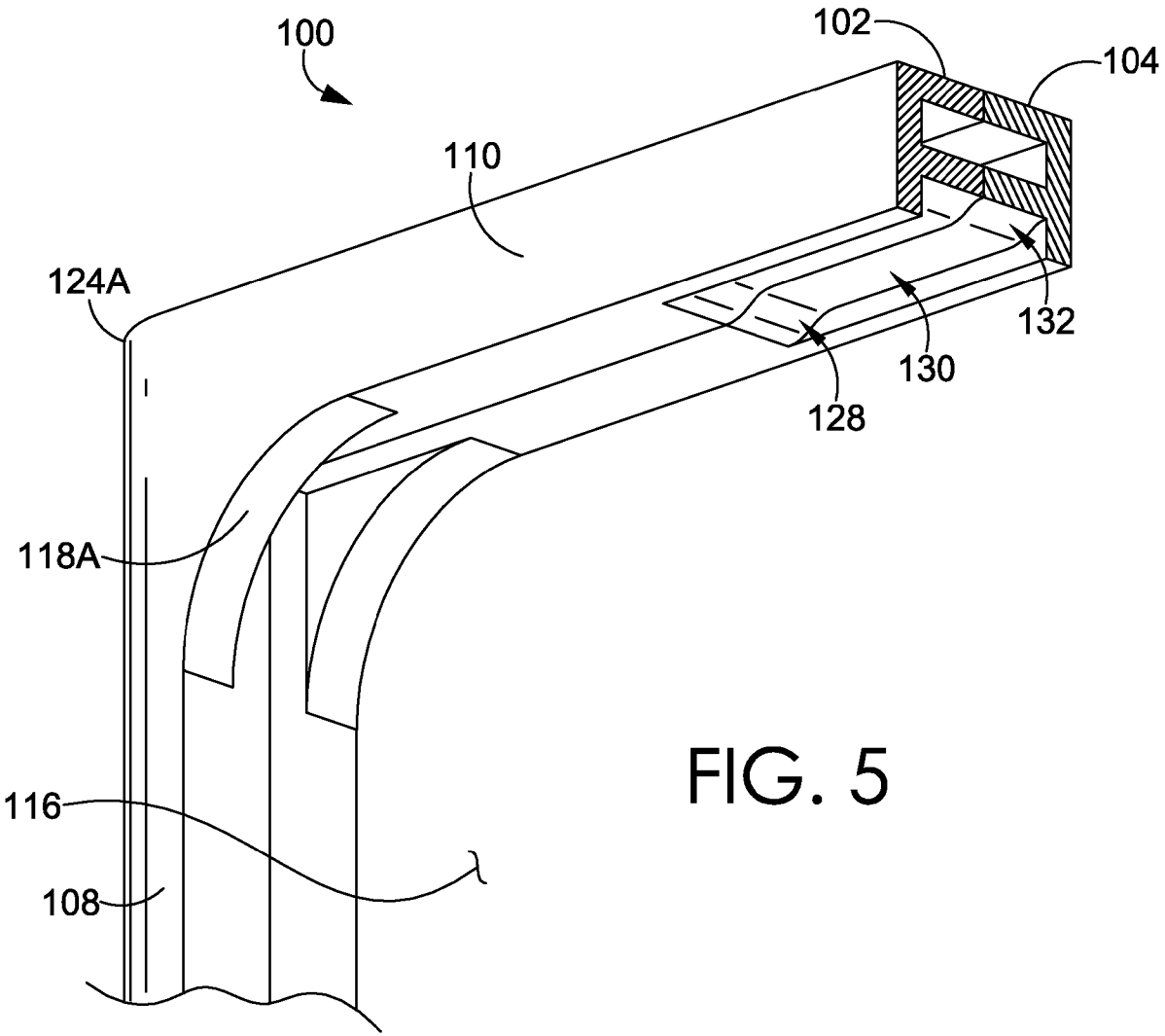
FIG. 5 is an enlarged partial cross section and fragmentary perspective view of a modular display frame, in accordance with an embodiment of the invention.

Turning now to FIG. 5, an enlarged partial cross section and fragmentary perspective view of the modular display frame 100, in accordance with an embodiment of the invention, is illustrated. In FIG. 5, a portion of the display frame 100 is shown in cross-section, the cross-section taken at the midpoint of the hanging feature 128, and extends to an exterior corner 124A of the second arm 110. In exemplary FIG. 5, the hanging feature 128 is offset from the exterior of each body, with respect to the perimeter of each body, such that the hanging feature 128 may not be outwardly visible. Each portion of the groove 130, when the first and second portions 102 and 104 are coupled, and/or mated together, creates an edge or ledge on which a nail head or screw may be caught in order to facilitate hanging the display frame 100. Each portion of the notch 132 is deeper than the groove 130 and shorter in length than the groove 130. As such, the notch 132 provides a small divot on which the head of a nail or screw may rest, and further, may be retained within. The smaller size of the notch 132 and the greater depth of the notch 132, in comparison to the groove 130, aid in hanging and leveling the display frame 100 as the catch of the nail or screw in the notch 132 can be felt and sensed without the need for a view of the hanging feature 128.

Additionally, the interior corners 118A, 118B, 118C and 118D of each portion are offset from the exterior of the body, such that the exterior of the display frame 100 has a smooth seamless appearance, in embodiments. The size, shape, and/or dimensions of the interior corners 118A, 118B, 118C and 118D are configured to receive corners of a photo, for example, inserted into the display area 116 by tucking a corner of said photo behind each interior corner 118A, 118B, 118C and 118D, such that the corner of the photo is caught within the interior of the body and is not outwardly visible. As each of the first and second portions 102 and 104 include at least one interior corner 118A, 118B, 118C and 118D, one or more photo corners may be tucked behind each interior corner 118A, 118B, 118C and 118D, positioning said photo corners between each of the first and second portions 102 and 104. In further embodiments, the mating elements of the first and second portions 102 and 104 are located within the interior of the body (see, e.g., FIG. 2B) such that the mating elements are not outwardly visible, as well. Alternatively, the mating element may be located on the exterior of the body such that they are outwardly visible.

Figure 6A:
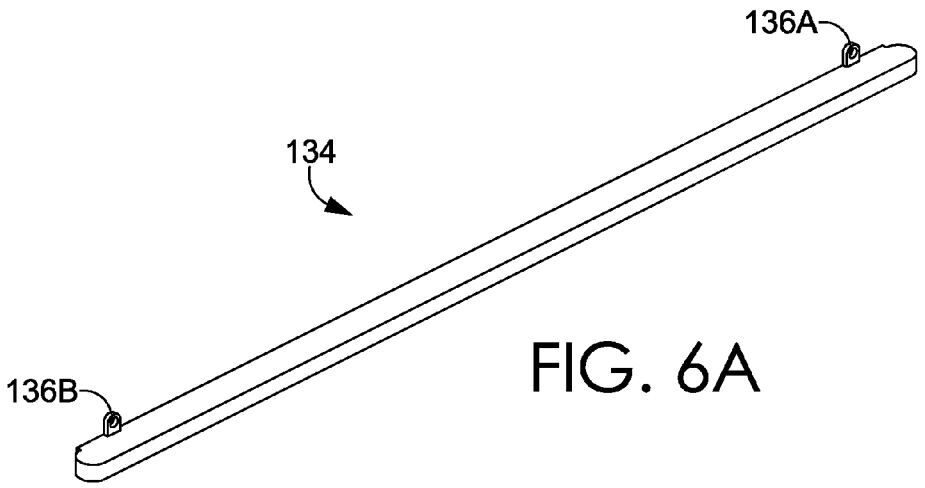
FIG. 6A is a front perspective view of a hanging bar component to which a modular display frame may be magnetically coupled, in accordance with an embodiment of the invention.

FIG. 6A is a front perspective view of a hanging bar component 134 to which the modular display frame of FIG. 1 may be magnetically coupled, in accordance with an embodiment of the invention. Generally, the hanging bar component 134 is long and slender, forming a bar or rail to which one or more display frames may be magnetically coupled. The hanging bar component 134 may include one or more flat or substantially planar surface to which one or more display frames may be magnetically coupled. The one or more flat or substantially planar surfaces may be preferentially magnetically coupled to a flat surface of one or more arms of a display frame, for example, based on the prior discussion of magnet placement within pockets to utilize the strongest areas of a magnetic field. Additionally and/or alternatively, one or more flat or substantially planar surfaces may be magnetically coupled to a curved surface of one or more arms of a display frame, in another example. The hanging bar component 134 further includes at least one securing component 136A and 136B to facilitate affixing the hanging component to a surface (e.g., a wall, door, or other planar surface). The securing component 136A and 136B may be of a general picture hanging type (e.g., having an aperture large enough to receive the body of a nail or screw but small enough to retain the head of the nail or screw). As such, the at least one securing component 136A and 136B, when used to affix the hanging bar component 134 to a surface, may further be configured and/or constructed to support more than one display frame magnetically coupled to the hanging bar component 134.

Figure 6B:
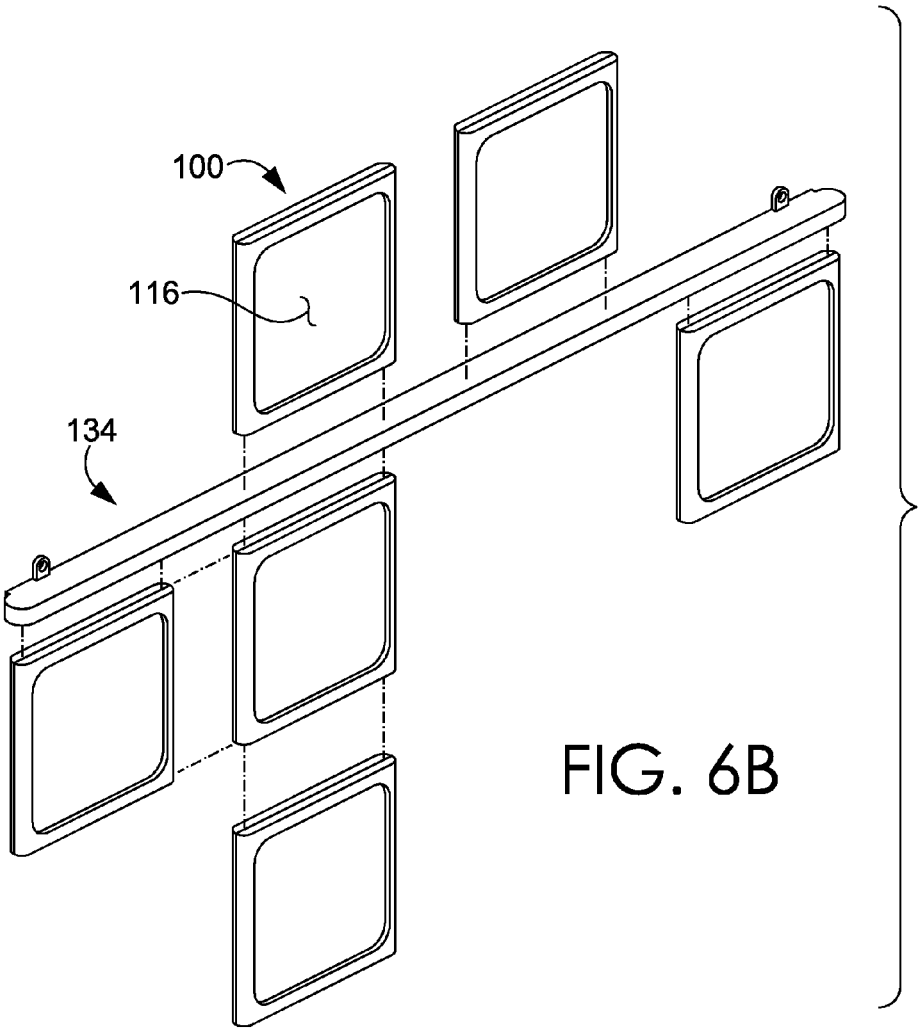
FIG. 6B is an exploded front perspective view of a hanging bar component with a plurality of modular display frames magnetically coupled thereto, in accordance with an embodiment of the invention.

Referring now to FIG. 6B, an exploded front perspective view of a hanging component as magnetically coupled to a plurality of modular display frames is depicted, in accordance with an embodiment of the invention. As shown, the hanging bar component 134 is configured to be magnetically coupled to the at least one display component. Generally, at least one magnet secured in one or more pockets of a display frame 100 (i.e., display component) is used to magnetically couple said display frame 100 to the at least one hanging bar component 134. In embodiments, the hanging bar component 134 is constructed of a ferromagnetic material to facilitate magnetic coupling to one or more display frames. Additionally or alternatively, the hanging bar component 134 may be coated with a ferromagnetic substance or material to facilitate magnetic coupling to one or more display frames, in some embodiments. In yet another embodiment, the hanging bar component may be of a plastic material that is molded to include pockets therein which receive magnets. The pockets and magnets therein may be spaced to align with the pockets and magnets within the display frames to self-align the display frames when coupled to the hanging bar component 134. In this embodiment the outer material of the hanging bar component may be the same material from which the display frames 100 are made, such that they have the same appearance.

As shown in exemplary FIG. 6B, a plurality of display frames may be coupled to the hanging bar component 134 simultaneously, in embodiments. Further, the plurality of display frames may be coupled to the hanging bar component 134 and to additional display frames simultaneously. In that regard, some display frames 100 may rest upon an upper surface of the hanging bar component 134 while some are magnetically coupled to a lower surface of the hanging bar component. Additional display frames 100 may be coupled to the lower edges of the display frames hanging from underneath the hanging bar component and others to those and so on, the number of additional display frames being hung only being limited by the strength of magnets therein and the weight of the display frames 100.

The hanging bar component 134 may provide a stabilizing and strengthening structure which facilitates the display of more display frames in more configurations, in embodiments. Due to the ease of magnetic coupling, one or more display frames may be easily rearranged using the hanging bar component 134 and/or other display frames. Further, the display frame 100 displaying a display object when viewed via the first portion 102 may be easily decoupled, flipped over or reversed in order to display a different photo, for example, when viewed via the second portion 103. This versatility and ease of change further promotes customization and interaction with the system.

Figure 7B:
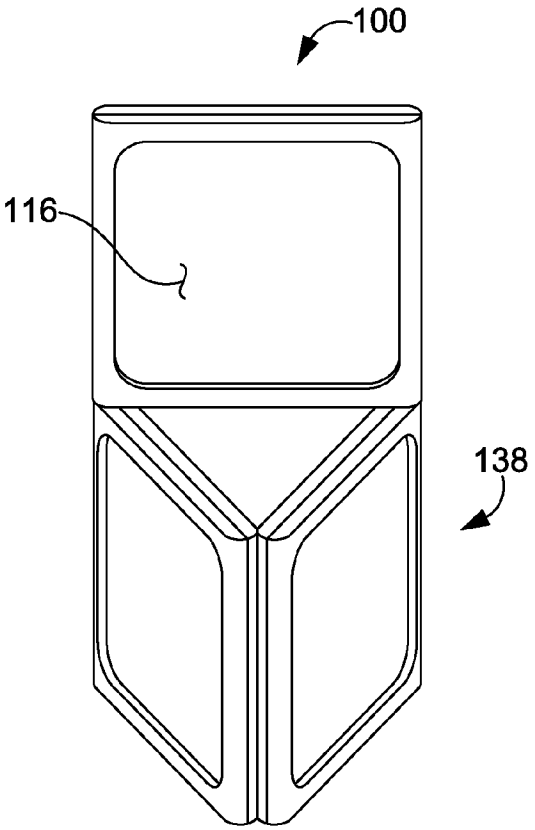
FIG. 7B is a front perspective view of an alternate exemplary display configuration of magnetically coupled modular display frames, in accordance with an embodiment of the invention.
Figure 7A:
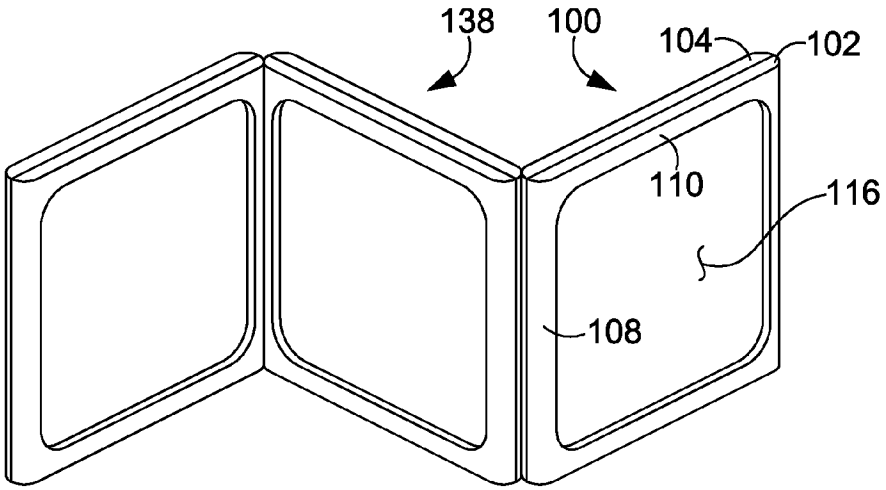
FIG. 7A is a front perspective view of an exemplary display configuration of a plurality of magnetically coupled modular display frames, in accordance with an embodiment of the invention.

FIG. 7A is a front perspective view of an exemplary display configuration of magnetically coupled modular display frames 100, in accordance with an embodiment of the invention. As shown in exemplary FIG. 7A, when the first portion 102 and the second portion 104 are mated with one another, adjacent arms of each portion may create a combined and/or composite convex-like or curved surface, side, or edge, or alternatively, a combined and/or composite flat surface, side, or edge, in some embodiments. In further embodiments, at least two composite curved surfaces are formed such that said surfaces are located opposite one another on a display frame. Additionally and/or alternatively, at least two composite flat surfaces are formed such that said surfaces are located opposite one another on a display frame, in yet further embodiments. Generally, in embodiments, a display frame includes at least one combined curved side and at least one combined flat side. In further embodiments, the display frames includes a pair of curved sides opposing one another and a pair of combined flat sides opposing one another. In one example, if the first arm 108 of the first portion 102 and the first arm of the second portion 104 are quarter-elliptical in shape, then when the first portion 102 and the second portion 104 are mated with one another, the first arm 108 of the first portion 102 and the first arm of the second portion 104 are adjacent to one another and form a half-elliptical shape for facilitating angled configurations of the display frame 100 magnetically coupled to an adjacent second display frame 138. For example, rounded sides of the display frame 100 allow for a wide range of display angles when a display frame 100 is magnetically coupled to another or second display frame 138. Accordingly, adjacent display frames may be angled invariably through a wide range of available angles permitted by the rounded shape.

In a further example, if the second arm 110 of the first portion 102 and the second arm of the second portion 104 each have at least one flat surface, then when the first portion 102 and the second portion 104 are mated with one another the second arm 110 of the first portion 102 and the second arm 110 of the second portion 104 are adjacent to one another and form a combined flat surface that permits the display frame 100 to rest on a horizontal surface in an upright configuration. Additionally, the combined flat surface enables stacking the display frame 100 onto another or second display frame 138, as illustrated in FIG. 7B, which depicts a front perspective view of an exemplary display configuration of magnetically coupled modular display frames, in accordance with an embodiment of the invention. As such, a plurality of display frames may be stacked vertically utilizing combined flat surfaces and displayed horizontally at various angles along combined curved surfaces.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A display frame comprising:

a first portion and a second portion being the same or similar in dimension, the first portion and the second portion configured to mate with one another to form the display frame, each of the first portion and the second portion including:

a body having a first arm, a second arm, a third arm, and a fourth arm, the first arm opposing the third arm, the second arm opposing the fourth arm, wherein each of the first, second, third and fourth arms are terminally connected to each other to create a display area and form a perimeter of the body having four exterior corners and four interior corners, each of the four interior corners having a fillet shape, each of the four exterior corners having a pocket adjacent thereto configured to receive at least a portion of a magnet, wherein when the first portion and the second portion are mated with one another, each pocket of the first portion aligns with a corresponding pocket of the second portion, and each pair of aligned pockets receives corresponding portions of the same magnet.

2. The display frame of claim 1, wherein the pockets proximate the four exterior corners are located on the interior the display frame when the first portion and the second portion are mated with one another.

3. The display frame of claim 1, wherein the first arm is quarter-elliptical in shape such that when the first portion and the second portion are mated with one another, the first arm of the first portion and the first arm of the second portion are adjacent to one another and form a half-elliptical shape for facilitating angled configurations of the display frame magnetically coupled to a second display frame.

4. The display frame of claim 1, wherein the second arm has at least one flat surface such that when the first portion and the second portion are mated with one another the second arm of the first portion and the second arm of the second portion are adjacent to one another and form a combined flat surface for facilitating an upright configuration of the display frame.

5. The display frame of claim 1, wherein the first portion and the second portion are identical.

6. The display frame of claim 1, wherein each body further comprises a portion of a hanging feature such that when the first portion and the second portion are mated with one another the portion of the hanging feature of each body forms a whole hanging feature.

7. The display frame of claim 6, wherein each portion of the hanging feature further includes a groove with a centrally located a notch.

8. The display frame of claim 1, wherein each of the four interior corners has a fillet shape configured to secure one or more of an edge or corner of a photo received by the display area.

9. The display frame of claim 8, wherein each of the four interior corners has a fillet shape configured to secure one or more of an edge or corner of more than one photo received by the display area, such that the more than one photo may be simultaneously displayed in the display frame.

10. The display frame of claim 1, wherein the first and third arms are quarter-elliptical in shape such that when the first portion and the second portion are mated with one another, the first arm of the first portion and the first arm of the second portion are adjacent to one another and form a half-elliptical shape and the third arm of the first portion and the third arm of the second portion are adjacent one another and form a half-elliptical shape for facilitating angled configurations of the display frame magnetically coupled to a second display frame, wherein the second and fourth arms have at least one flat surface such that when the first portion and the second portion are mated with one another the second arm of the first portion and the second arm of the second portion are adjacent to one another and form a combined flat surface and the fourth arm of the first portion and the fourth arm of the second portion are adjacent to one another and form a combined flat surface for facilitating an upright configuration of the display frame.

11. One or more display frames, each display frame comprising:

a first half and a second half, the first half and the second half having mating elements for joining the first half to the second half to form the display frame, each of the first half and the second half comprising:

a body having a first arm terminally connected to a second arm, the second arm terminally connected to a third arm, the third arm terminally connected to a fourth arm, and the fourth arm terminally connected to the first arm such that a perimeter is formed around a display area, the body having four exterior corners corresponding to each terminal connection and four interior corners having a concave shape, the body further having a pocket proximate to each terminal connection, each pocket configured to house a portion of a magnet, wherein when the first half and the second half are joined with one another to form the display frame, each pocket of the first half aligns with a corresponding pocket of the second half to form pairs that secure a corresponding magnet, wherein each pair of aligned pockets houses respective portions of the same corresponding magnet, and wherein each magnet facilitates magnetic coupling of two or more display frames to one another.

12. The one or more display frames of claim 11, wherein the first arm and third arm have a bull-nose shape, such that when the first half and the second half are mated with one another the first arm of the first half and the first arm of the second half are adjacent to one another and form a convex shape and the third arm of the first half and the third arm of the second half are adjacent to one another and form a convex shape for facilitating angled configurations of the one or more display frames as magnetically coupled to one another.

13. The one or more display frames of claim 11, wherein the second arm and fourth arm have at least one flat surface such that when the first half and the second half are mated with one another the second arm of the first half and the second arm of the second half form a combined flat surface and the fourth arm of the first half and the fourth arm of the second half form a combined flat surface for facilitating an upright configuration of the display frame.

14. The one or more display frames of claim 11, each body having a portion of a hanging feature, each portion having a groove and a notch that is centrally located within the groove, such that when the first half and the second half are mated with one another the hanging feature is complete.

15. The one or more display frames of claim 11, wherein the at least one magnet proximate to each terminal connection magnetically couples the one or more display frames to one another along any of the first arm, the second arm, the third arm, and the fourth arm.

16. A modular display system comprising:

at least one display component configured to display one or more photos within a display area, the at least one display component comprising two identical portions configured to internally secure at least one magnet when the two identical portions are coupled to one another, the at least one magnet being internally secured using a pocket of each of the two identical portions, the at least one internally secured magnet located proximate to a corner of the display frame to facilitate magnetic coupling of the at least one display component to one or more of a second display component or a hanging component; and at least one hanging bar component for magnetically coupling to the at least one display component via the at least one internally secured magnet, the at least one hanging bar component having at least one securing component for facilitating affixing the hanging component to a surface.

17. The system of claim 16, wherein the hanging bar component is constructed of one of a ferromagnetic material or a plastic material with a magnet therein to facilitate magnetic coupling to the at least one display component.

18. The system of claim 16, wherein the hanging bar component has a ferromagnetic coating to facilitate magnetic coupling to the at least one display component.

19. The system of claim 16, wherein the at least one hanging bar component is configured to magnetically couple to more than one display component.

20. The system of claim 16, wherein the at least one securing component, when used to affix the hanging bar component to a surface, is configured to support more than one display component magnetically coupled to the at least one hanging bar component.

* * * * *